US008331817B2

(12) United States Patent
Watanabe

(10) Patent No.: US 8,331,817 B2
(45) **Date of Patent: *Dec. 11, 2012**

(54) IMAGE FORMING APPARATUS WITH DEVELOPER REMAINDER AMOUNT DETECTION FEATURE

(75) Inventor: Yasunari Watanabe, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/114,388

(22) Filed: May 24, 2011

(65) Prior Publication Data

US 2011/0222873 A1 Sep. 15, 2011

Related U.S. Application Data

(62) Division of application No. 12/166,928, filed on Jul. 2, 2008, now Pat. No. 7,970,306.

(30) Foreign Application Priority Data

Jul. 6, 2007 (JP) ..... 2007-178416
Jun. 26, 2008 (JP) ..... 2008-167464

(51) Int. Cl.
*G03G 15/10* (2006.01)
*G03G 15/08* (2006.01)

(52) U.S. Cl. ..... 399/61; 399/27

(58) Field of Classification Search ..... 399/27, 399/29, 30, 61, 62, 64

See application file for complete search history.

(56) References Cited

U.S. PATENT DOCUMENTS

| | | | |
|---|---|---|---|
| 5,649,264 | A | 7/1997 | Domon et al. |
| 7,095,964 | B2 | 8/2006 | Koyama et al. |
| 2006/0233560 | A1 | 10/2006 | Harada et al. |
| 2007/0206966 | A1 | 9/2007 | Komiya et al. |

FOREIGN PATENT DOCUMENTS

| | | | |
|---|---|---|---|
| JP | 5-6092 | A | 1/1993 |
| JP | 2001-318566 | A | 11/2001 |

*Primary Examiner* — Joseph S Wong

(74) *Attorney, Agent, or Firm* — Fitzpatrick, Cella, Harper & Scinto

(57) ABSTRACT

An image forming apparatus includes a developing device for developing a latent image formed on an image bearing member on the basis of image information, into a developed image with a developer, the developing device including a developer accommodating portion for accommodating the developer and a stirring member for stirring the developer in the developer accommodating portion; an optical remaining amount detecting device for detecting a remaining amount of the developer in the developer accommodating portion, by passing light through an inside of the developer accommodating portion; a consumption amount calculation device for calculating information relating to a consumption amount of the developer on the basis of the image information; and an outputting device for outputting an information signal indicative of a developer remainder which is either one of a developer remainder based on a detection result of the optical remaining amount detecting device and a developer remainder based on the information relating to the consumption amount provided by the consumption amount calculation device, selected in accordance with information relating to continuous drive time of the stirring member after start of drive thereof during image forming operation.

6 Claims, 13 Drawing Sheets

IMAGE FORMING APPARATUS WITH DEVELOPER REMAINDER AMOUNT DETECTION FEATURE

This application is a divisional of U.S. patent application Ser. No. 12/166,928, filed Jul. 2, 2008, which issued as U.S. Pat. No. 7,970,306, on Jun. 28, 2011.

FIELD OF THE INVENTION AND RELATED ART

The present invention relates to an image forming apparatus, such as a copying machine and a printer, which is provided with a function of forming an image on a recording medium, such as a sheet of paper, on which an image is recordable.

There have been disclosed various developer amount detecting or estimating methods, in order to inform a user (operator) of an image forming apparatus employing an electrophotographic image forming process, of the amount of developer remaining in the developing apparatus of the image forming apparatus.

One of the methods for directly detecting the amount of the developer remainder in a developing apparatus is disclosed in Japanese Laid-open Patent Application H05-6092. According to this method, the amount of the developer in a developing apparatus is detected by detecting the amount of electrostatic capacity of the body of developer in the developing apparatus, which is affected by the amount of the developer in the developing apparatus. Another method for directly detecting the amount of the developer remainder in the developing apparatus is disclosed in U.S. Pat. No. 5,649,264. This method uses a combination of an infrared LED and an optical sensor.

The above-described developer remainder amount detecting methods, which directly detect the amount of the developer in the developing apparatus, are problematic in that the accuracy of these methods is liable to be affected by the state of the developer in the developing apparatus, more specifically, how well the developer in the developing apparatus has been loosened by being stirred. Laid-open United States Patent Application 2006-0233560 discloses one of the solutions to the above-described problem. According to this application, in order to eliminate this problem, a developer remainder amount detection sequence is independently carried out from an image forming operation. In this sequence, the amount of the developer in the developing apparatus is measured after the developer is loosened (stirred) enough to accurately measure the amount of the developer, according to a preset amount of usage (cumulative number of rotation of development roller, information regarding number of printed picture elements, etc.) of the developing apparatus.

There are also methods for indirectly measuring (estimating) the amount of the developer remainder in a developing apparatus. One of these methods is disclosed in Japanese Laid-open Patent Application 2001-318566. According to this patent application, the amount of developer consumption is estimated based on the information regarding the image which has been formed, and the estimated amount of developer consumption is used to estimate the amount of the developer remaining in the developing apparatus.

It has been known that if the amount of the developer remainder in a developing apparatus is estimated solely based on the estimated amount of developer consumption, the cumulative amount of error in the estimation of the developer consumption gradually increases with the increase in the amount of developing apparatus usage. More specifically, the amount of developer consumption per picture element is affected by whether an image to be formed is a graphic image (image made up of solid areas) or a textual image. Therefore, it is possible that even if two images to be formed are the same in picture element count, the two images will be significantly different in the actual toner consumption. Thus, it is possible that the amount of developer consumption estimated based on the picture element count alone of an image to be formed will be significantly different from the actual amount of developer consumption.

U.S. Pat. No. 7,095,964 discloses the following method for successively detecting the amount of the developer in a developing apparatus. This developer remainder amount detecting method is a combination of the above-described developer remainder amount detecting method (U.S. Pat. No. 5,649,264) which uses an optical sensor to detect the amount of the developer remainder, and the developer remainder amount detecting method (Japanese Laid-open Patent Application 2001-318566) which uses the amount of developer consumption estimated based on the information regarding the image to be formed, to estimate the amount of the developer remainder.

In order to simplify the replenishment of a developing apparatus with developer, and/or the maintenance of a developing apparatus, some electrophotographic image forming apparatuses are structured to employ a development process cartridge, which is removably mountable in the main assembly of an electrophotographic image forming apparatus, or a so-called process cartridge, that is, a cartridge in which a photosensitive member and processing means other than a developing apparatus, are disposed in addition to a developing apparatus so that they can be removably mountable in the main assembly of an electrophotographic image forming apparatus.

In a case where a system for detecting the developer remainder amount is insufficient in accuracy, a system for estimating the amount of developer consumption is sometimes used to estimate the amount of developer remainder, as described above.

Developer has a tendency that if it is left unattended for a certain length of time, it agglomerates due to its own weight, changing in fluidity. Thus, the value of the amount of the developer remainder in a developing apparatus, which is obtained when the developer in a developing apparatus is at a certain level of fluidity, and that which is obtained when the same developer is at another level of fluidity, are sometimes different from each other.

SUMMARY OF THE INVENTION

The present invention was made in consideration of the cases described above. Thus, the primary object of the present invention is to highly reliably detect the amount of the developer remaining in a developing apparatus, even when the condition of developer prevents a developer remainder amount detecting system from accurately detecting the amount of the developer in the developing apparatus.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the present invention will be described in detail with reference to its preferred embodiments. Incidentally, the measurements, materials, and shapes of the structural components of the image forming apparatus, and the positional relationship among them, in the following preferred embodiments of the present invention, are not intended to limit the present invention in scope. That is, they are to be modified as necessary according to the structures of an apparatus to which the present invention is applied, and the various conditions under which the image forming apparatus in accordance with the present invention is used.

The present invention relates to the control of a method for detecting the developer remainder amount in an image forming apparatus employing an electrophotographic image forming method.

Embodiment 1

Image Forming Apparatus

Figure 1:
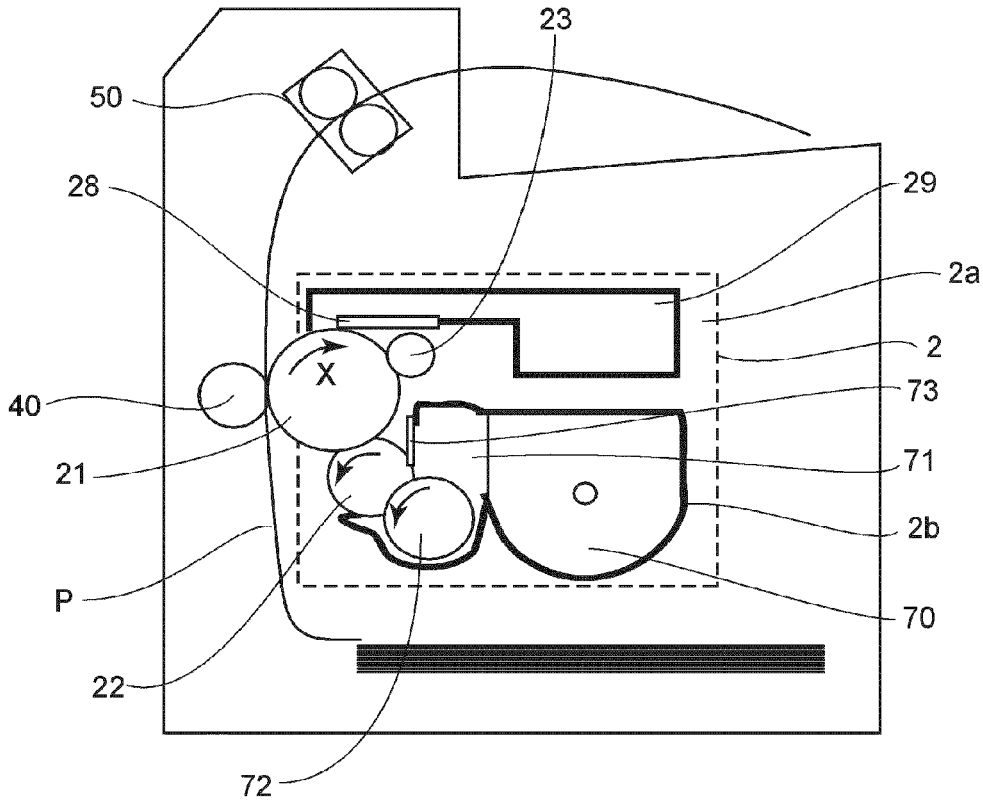
FIG. 1 is a schematic drawing of a typical image forming apparatus in accordance with the present invention, showing the general structure of the apparatus.

FIG. 1 is a schematic drawing of an image forming apparatus in the first embodiment of the present invention, and shows the general structure of the apparatus.

A referential number 21 in the drawing designates a photosensitive drum as an image bearing member. The image forming apparatus in this embodiment employs a process cartridge 2, in which the photosensitive drum 21 and processing means, more specifically, a charge roller 23 as a charging apparatus, a development roller 22 (of developing apparatus 2*b*) as a developing means which processes the photosensitive drum 21 (develops electrostatic image on photosensitive drum 22), a transfer roller 40 as a transferring apparatus, and a cleaning blade 28, are integrally disposed. The processing means are disposed in the adjacencies of the peripheral surface of the photosensitive drum 21, in contact, or virtually in contact, with the photosensitive drum 21, in a manner to surround the photosensitive drum 21. The photosensitive drum 21, charge roller 23, and cleaning blade 38 are integrated as a photosensitive drum unit 2*a*, a part of which makes up a waste toner storage container 29.

The developing apparatus 2*b* is a part of a development unit made up of a development unit frame 71, the development roller 22, a toner supply roller 72, a development blade 73, and a toner stirring member 74 as a toner stirring means. The development unit frame 71 includes a toner storage portion 70 as a developer storage portion. Hereafter, the developing apparatus 2*b* may be referred to as a development unit 2*b*.

Next, the image forming operation of the image forming apparatus in this embodiment will be described.

The photosensitive drum 21 is rotated by a driving apparatus (not shown) at a preset peripheral velocity in the direction indicated by an arrow mark X. To the charge roller 23, a charge bias is applied from an electric power source (not shown) to uniformly charge the peripheral surface of the photosensitive drum 21 to a preset potential level. The uniformly charged area of the peripheral surface of the photosensitive drum 21 is exposed by a laser-based exposing apparatus (not shown), to form a latent image on the charged area.

The latent image formed on the peripheral surface of the photosensitive drum 21 is moved into the area of contact between the photosensitive drum 21 and development roller 22, in which the latent image is developed by toner D, which is supplied thereto as developer by the development roller 22, into a visual image, that is, an image formed of toner, which hereafter will be referred to as a toner image (developer image). In this embodiment, a nonmagnetic single-component toner is used as the toner D. To the development roller 22, a development voltage is applied from an electric power source (not shown) to provide a development bias between the development roller 22 and photosensitive drum 21.

The toner image is moved into the area of contact between the transfer roller 40 and photosensitive drum 21, in which the toner image is transferred onto a recording medium P. More accurately, the toner image is moved into the area of contact between the transfer roller 40, and the recording medium P which is sent into the area of contact between the transfer roller 40 and photosensitive drum 21 with the same timing as the timing with which the toner image is moved into the area of contact between the transfer roller 40 and photosensitive drum 21, so that the toner image is transferred onto the recording medium P in the area of contact between the recording medium P and photosensitive drum 21. To the transfer roller 40, a development voltage is applied from an electric power source (not shown) to provide a transfer bias between the transfer roller 40 (recording medium P) and photosensitive drum 21.

After the transfer of a toner image onto the recording medium P, the recording medium P is sent to a fixing apparatus 50, in which heat and pressure is applied to the recording medium and the toner image thereon to fix the toner image to the recording medium P.

As for the portion of the toner D on the photosensitive drum 21, which was not transferred onto the recording medium P, that is, the portion of the toner D, which remained on the photosensitive drum 21 after the toner image transfer, is scraped down from the photosensitive drum 21 by the cleaning blade 28, and is stored in the waste toner storage container 29. The area of the peripheral surface of the photosensitive drum 21, from which the residual toner has been removed, is charged again by the charge roller 23, and is used for the next phase of the image forming operation.

In the case of the image forming apparatus shown in FIG. 1, the photosensitive drum unit 2*a* and development unit 2*b* are integrated as a process cartridge 2 structured to be removably mountable in the main assembly of the image forming apparatus.

(Development Unit)

Figure 2:
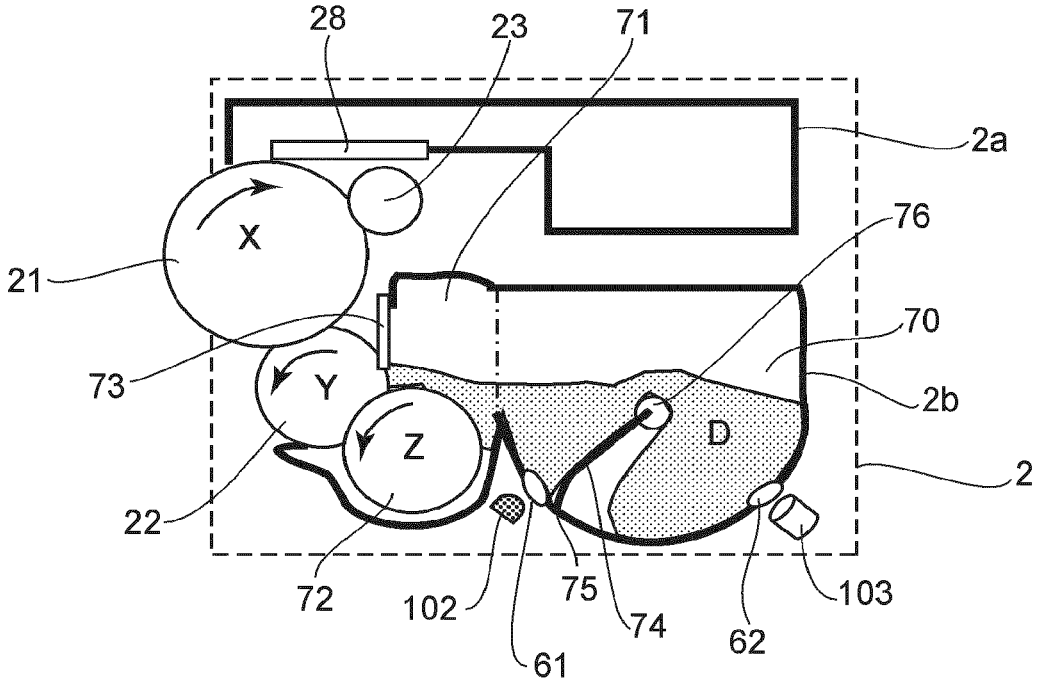
FIG. 2 is a schematic sectional view of the process cartridge in the first embodiment of the present invention.

Next, referring to FIG. 2, the development unit 2*b* in this embodiment will be described in detail. FIG. 2 is a schematic sectional view of the process cartridge 2.

The development unit 2*b* is made up of the development roller 22, toner supply roller 72, and developer unit frame 71 having the developer container. The development roller 22 and toner supply roller 72 are rotatably supported by the development unit frame 71, and are positioned so that the peripheral surface of the toner supply roller 72 is virtually in contact with the peripheral surface of the development roller 22. The rotational direction of the toner supply roller 72 and that of the development roller 22 are the same as shown by arrow marks Y and Z, respectively, in FIG. 2 (two rollers 72 and 22 are opposite in direction in which their peripheral surfaces move in area of virtual contact between two rollers). The development roller 22 is made up of a metallic core, and a layer of electrically conductive rubber, which has a preset set amount of volumetric electrical resistance and is coated on the peripheral surface of the metallic core in a manner to completely cover the peripheral surface of the metallic core. The toner supply roller 72 is made up of a metallic core, and a layer of foamed urethane, which is coated on the peripheral surface of the metallic core in a manner to completely cover the peripheral surface of the metallic core. The substantial number of foam cells which are at the peripheral surface of the layer of foamed urethane are open, making it easier for the toner supply roller 72 to hold and convey the toner D.

The development blade 73 is a piece of elastic plate formed of a flexible substance such as phosphor bronze. The development blade 73 is fixed to the development unit frame 71 by one of its long edge portions in such a manner that the surface of the other long edge portion of the development blade 73 rubs against the peripheral surface of the electrically conductive elastic rubber layer of the development roller 22.

The toner stirring member 74 is positioned in the toner storage portion 70 so that it is rotatable about a rotational axle 76. Further, the toner stirring member 74 is positioned so that its functional edge 75 comes into contact with the bottom surface of the toner storage portion 70 as the toner stirring member 74 is rotated. The bottom portion of the bottom wall of the toner storage portion 70 is provided with a pair of transparent windows 61 and 62 (light entrance window 61 and light exit window 62). The toner stirring member 74 and toner storage portion 70 are structured so that as the toner stirring member 74 is rotated, its functional edge 75 comes into contact with the transparent windows 61 and 62 and temporarily moves the portions of the toner D, which are on the transparent windows 61 and 62 (in order words, to clean transparent windows 61 and 62).

Next, the toner movement which occurs in the development unit 2*b* when the development unit 2*b* is driven will be described.

As the development unit 2*b* is driven, the development roller 22, toner supply roller 72, and the toner stirring member 74 rotate in the direction indicated by the arrow marks in FIG. 2.

As the toner stirring member 74 in the toner storage portion 70 rotates, the toner D in the toner storage portion 70 (in developing means) is conveyed toward the toner supply roller 72 while being stirred, and then, is borne on the foamed urethane layer of the toner supply roller 72. Then, the toner D borne on the foamed urethane layer of the toner supply roller 72 is moved by the rotation of the toner supply roller 72 to the area of contact between the toner supply roller 72 and development roller 22. In the area of contact between the toner supply roller 72 and development roller 22, the peripheral surface of the toner supply roller 72 and the peripheral surface of the development roller 22 move in the opposite direction from each other. Therefore, a part of the toner D on the toner supply roller 72 transfers onto the peripheral surface of the development roller 22 while being rubbed by the peripheral surfaces of the toner supply roller 72 and development roller 22, and adheres to the peripheral surface of the development roller 22.

The toner D having adhered to the peripheral surface of the development roller 22 is sent to the development blade 72 by the rotation of the development roller 22. The development blade 73 regulates the toner D on the development roller 22 in such a manner that a thin and uniform layer of toner D is formed on the peripheral surface of the development roller 22, while frictionally charging the toner D.

After being formed into a thin and uniform layer, the toner D is sent to the area of contact between the development roller 22 and photosensitive drum 21 by the further rotation of the development roller 22, and is used to develop a latent image on the photosensitive drum 21. The portion of the toner D on the development roller 22, which was not used for the development, that is, the portion of the toner D on the development roller 22, which remained on the development roller 22 after the development, is conveyed to the area of contact between the toner supply roller 72 and development roller 22, in which it is removed from the peripheral surface of the development roller 22 by the toner supply roller 72. The removed toner D is returned to the toner storage portion 70, and is mixed with the toner D in the toner storage portion 70 as it is stirred together with the toner D which was in the toner storage portion 70.

(Toner Amount Detecting Means)

Figure 3:
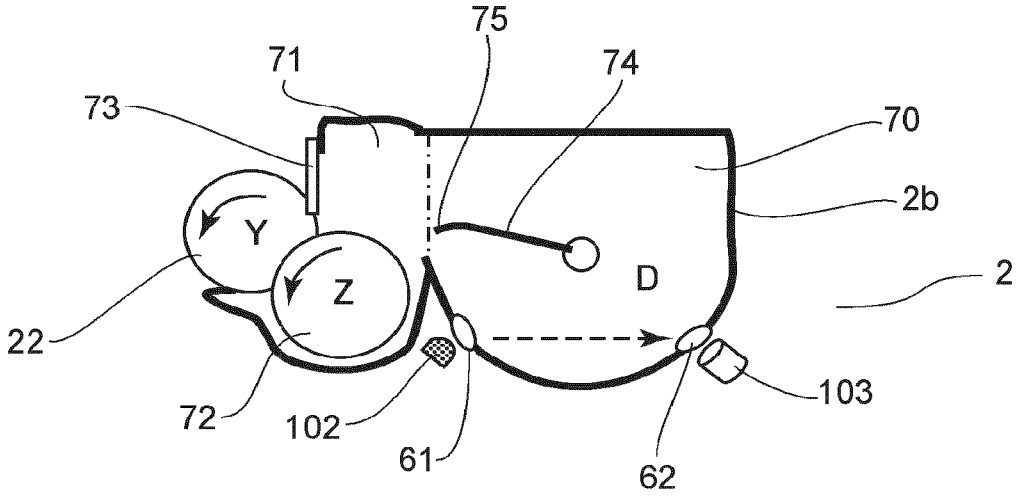
FIG. 3 is a schematic sectional view of the process cartridge in the first embodiment of the present invention, describing the method for detecting the amount of the toner in the developing apparatus, based on light transmission.
Figure 4:
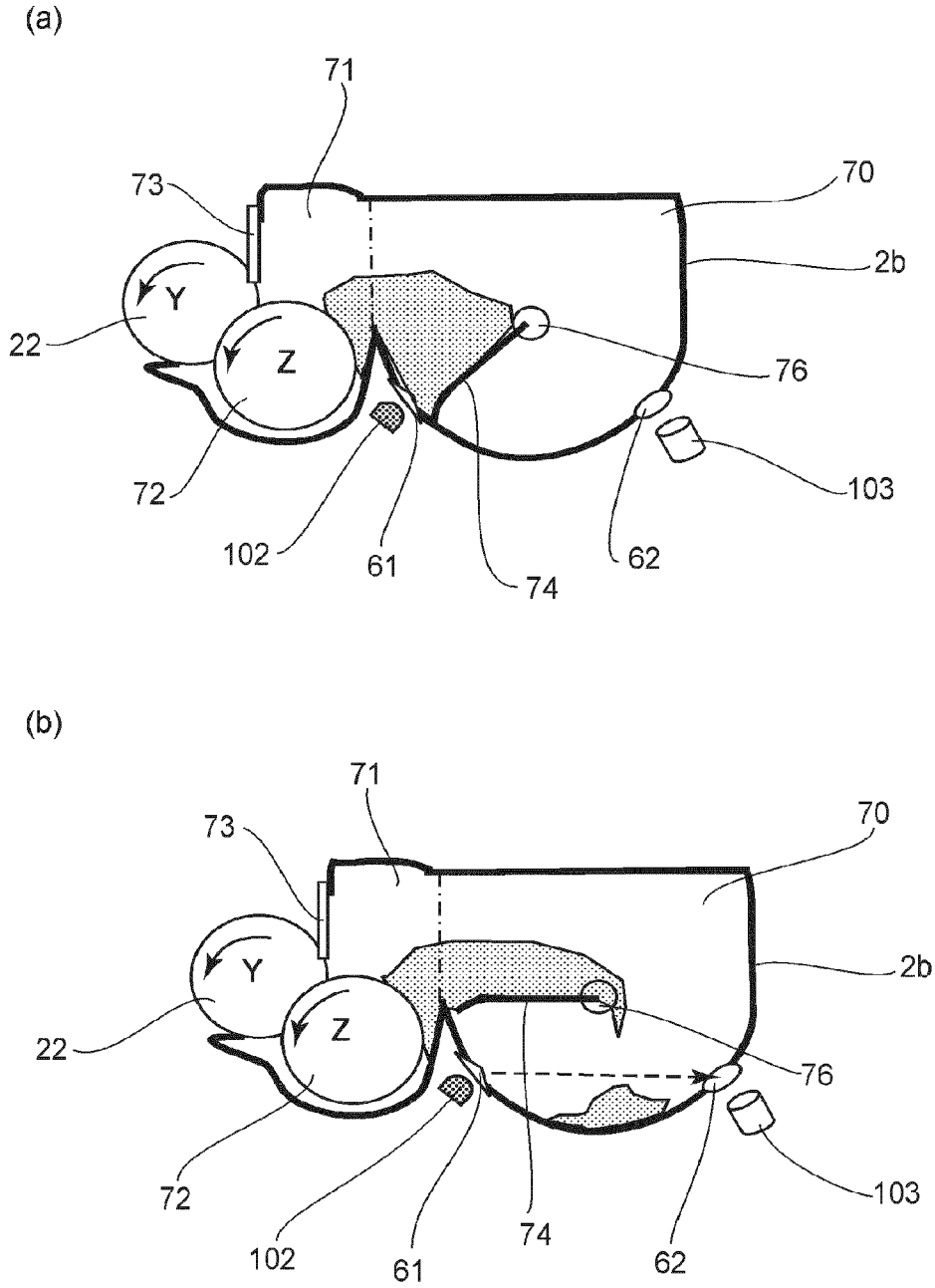
FIG. 4 is a schematic drawing of the process cartridge in the first embodiment of the present invention, describing the toner remainder amount detecting method in the first embodiment of the present invention.

Next, referring to FIGS. 3 and 4, the toner amount detecting method in this embodiment, which detects the amount of toner in the developing apparatus based on the light transmission through the toner storage portion 70 of the developing apparatus, will be described. FIG. 3 is a schematic drawing of the developing apparatus, which is for describing the toner amount detecting method in this embodiment, which is based on the light transmission through the toner storage portion 70. FIG. 4 is also a schematic drawing of the developing apparatus, which is for describing the toner amount detecting method in this embodiment, which is based on the light transmission through the toner storage portion 70.

Referring to FIG. 3, the image forming apparatus is provided with a light emitting portion 102 which emits a beam of light for detecting the amount of toner remainder, and a light receiving portion 103 which receives the beam of light transmitted through the toner storage portion 70. In this embodiment, the light emitting portion 101 is an LED, and the light receiving portion 103 is a phototransistor (PTR). The toner amount detecting method in this embodiment, which is based on light transmission, is a method for detecting the amount of the toner remaining in the toner storage portion 70, by transmitting a beam of light through the toner storage portion 70.

When there is no toner in the toner storage portion 70, the beam of light emitted from the light emitting portion 102 enters the toner storage portion 70 through the transparent window 61, transmits through the toner storage portion 70, comes out of the toner storage portion 70 through the transparent window 62, and reaches the light receiving portion 103. Obviously, the process cartridge is structured so that when there is a sufficient amount of toner D in the toner storage portion 70, the light path between the transparent windows 61 and 62 is blocked by the toner D, and therefore, the beam of light which enters the toner storage portion 70 through the transparent window 61 does not reach the light receiving portion 103.

In the case of the structure of the process cartridge in this embodiment, the toner stirring member 74 continues to rotate at a preset frequency even during the detection of the amount of the toner in the toner storage portion 70. Therefore, even when there is no toner D in the toner storage portion 70, a period in which the beam of light is received by the light receiving portion 103, and a period in which the beam of light is not received by the light receiving portion 103, alternate.

FIG. 4(*a*) shows the process cartridge when a certain amount of toner D is still present in the toner storage portion 70, and the beam of light is blocked by the toner D which is being conveyed by the tip portion 75 of the toner stirring member 74. FIG. 4(*b*) shows the process cartridge when the conveyance of the toner D has reduced the amount of the toner D conveyable by the tip portion 75 of the toner stirring member 74 to a value so small that the beam of light from the light emitting portion 102 is allowed to reach the light receiving portion 103.

When the amount of the toner D in the toner storage portion 70 is large enough for the tip portion 75 of the toner stirring member 74 to convey the toner D, the length of time the beam of light is blocked (FIGS. 4(*a*) and 4(*b*)) is longer than when there is no toner D remaining. The length of time the beam of light is blocked corresponds to the amount of the toner D in the toner storage portion 70. Therefore, the amount of the toner D in the toner storage portion 70 can be determined by calculating the ratio of the length of time the beam of light remains blocked to the length of time it takes for the toner stirring member 74 to rotate once (which hereafter will be referred to as single rotation time of stirring member). Incidentally, the amount of the toner D in the toner storage portion 70 can be determined by calculating the ratio of the length of time the beam of light is received, to the length time it takes for the stirring member to make a single full rotation, instead of calculating the ratio of the length of time the beam of light remains blocked per rotation of the stirring member to the length of time it takes for the stirring member to make one full rotation.

Figure 5:
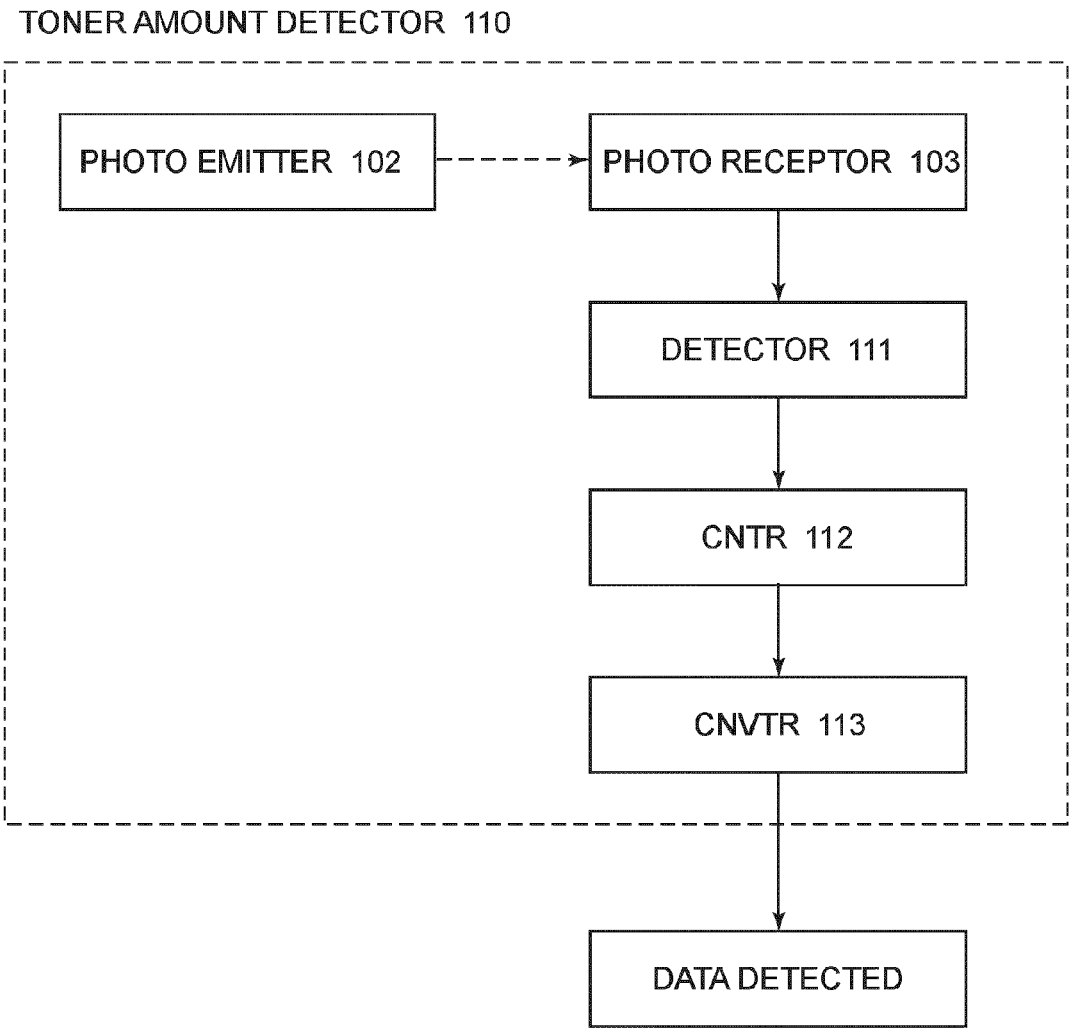
FIG. 5 is a block diagram of the circuit of the toner remainder amount detecting means in the first embodiment of the present invention.

FIG. 5 is a block diagram of the circuit of the toner amount detecting means 110 as the developer amount detecting means in this embodiment.

The toner amount detecting means 110 (optical toner remainder amount detecting apparatus) is provided with a received light amount detecting portion 111, a light reception time duration counter 112, and a toner amount computing portion 113, in addition to the light emitting portion 102 and light receiving portion 103, as shown in FIG. 5.

The output of the light receiving portion 103 is inputted into the received light amount detecting portion 111, which outputs signals (which hereafter will be referred to as light reception signal) to the light reception duration counter 112 only when the amount of the light received by the light receiving portion 103 is greater than a preset level. The light reception duration counter 112 cumulatively measures the length of time it received the light reception signal, and sends the value of the cumulative length of time it received the light reception signal, to the toner amount computing portion 113, which calculates the amount of the toner D in the toner storage portion 70 based on the value sent from the light reception duration counter 112 and the length of the stirring member rotation time, and sends the calculated amount of the toner D in the toner storage portion 70 to a controlling means 140, which will be described later.

(Toner Consumption Amount Estimating Means)

Next, a toner consumption amount estimating means 120 (calculating means) for estimating the amount of the toner consumption (developer consumption) which occurs during an image forming operation, will be described.

Generally, the amount of toner consumption in an image forming operation is proportional to the amount of the information (picture element count (pixel count)) regarding the image to be formed on a recording medium by the image forming operation. Therefore, the amount W of toner consumption is estimated with the use of the following mathematical equation:

$$W = PC \times W\text{dot} \quad (1)$$

W: amount of toner consumption

PC: pixel count

Wdot: amount of toner consumption per pixel.

Figure 6:
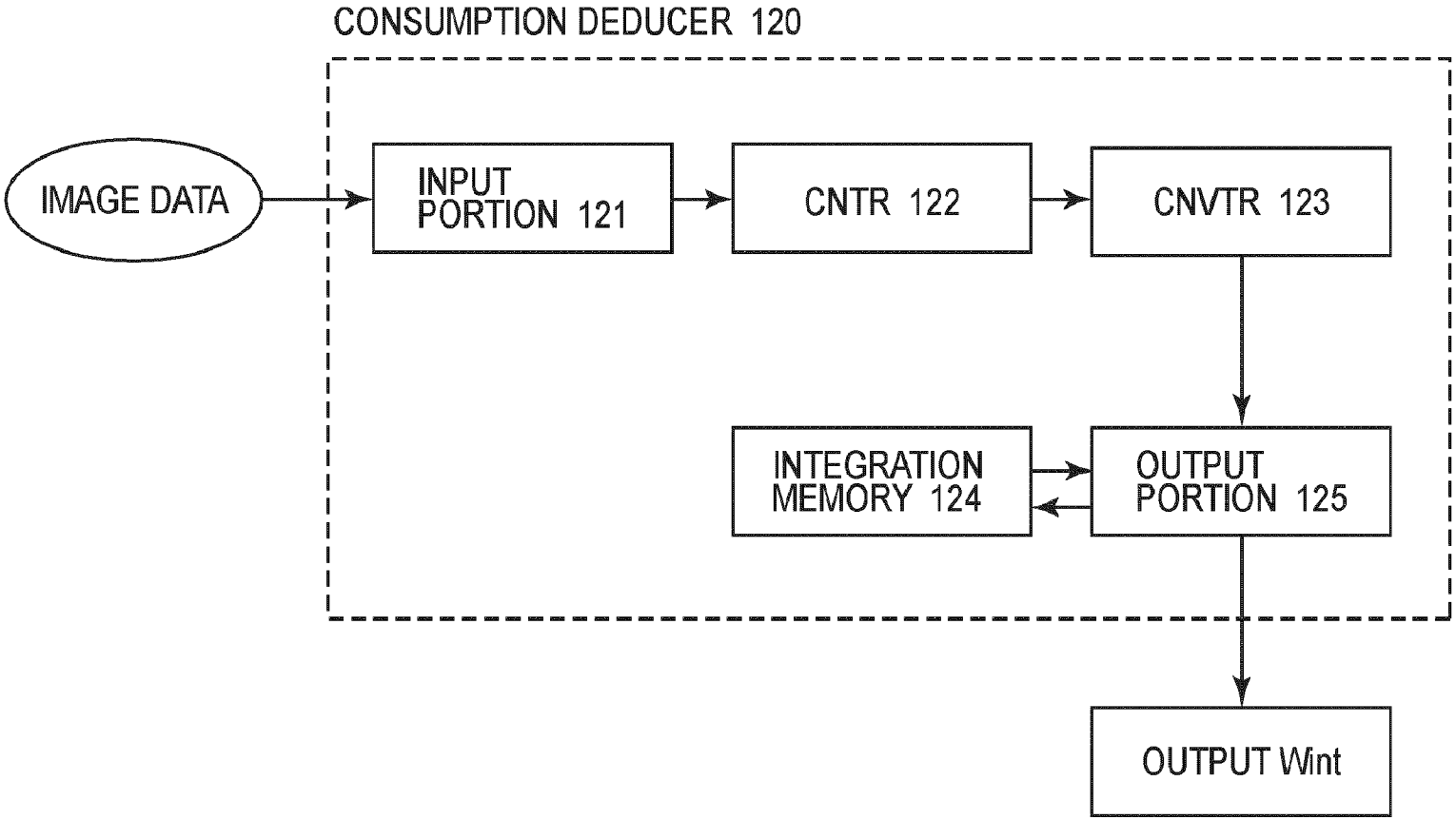
FIG. 6 is a block diagram of the circuit of the toner consumption amount estimating means in the first embodiment of the present invention.

FIG. 6 is a block diagram of the circuit of the toner consumption amount estimating means 120 in this embodiment.

The toner consumption amount estimating means 120 is provided with a picture element signal inputting portion 121, a picture element signal counter 122, a toner consumption amount estimating portion 123, a cumulative toner consumption amount storage portion 124, and a toner consumption amount data outputting portion 125.

The image formation data sent from outside the image forming apparatus are developed by a formatter of the image forming apparatus, being thereby converted into picture element signals which correspond to the image to be formed. The thus obtained picture element signals are inputted into the picture signal inputting portion 121, by which they are modified so that they can be easily counted by the picture element signal counter 122.

The picture element signal counter 122 counts, for a preset length time, the picture element signals modified by the picture element signal inputting portion 121, and outputs the value of the above-mentioned picture element signal count (PC) for every preset length of time. The outputted PC value is sent to the toner consumption amount estimating portion 123, which calculates the amount W of toner consumption, with the use of the above-mentioned mathematical equation (1). The thus obtained toner consumption amount W is sent to the cumulative toner consumption amount storage portion 124 through the toner consumption amount data outputting portion 125. In the cumulative toner consumption amount storage portion 124, the newly inputted cumulative toner consumption amount W is added to the cumulative toner consumption amount data Wint which has been stored in the storage portion 124, and the sum of the two data is stored as the new cumulative toner consumption amount data Wint, in the storage portion 124.

The toner consumption data outputting portion 125 reads and outputs the cumulative toner consumption amount data Wint in the cumulative toner consumption amount storage portion 124, in response to the request from the controlling means 140, which will be described later. Further, the toner consumption amount outputting portion 125 is structured so that it can reset the value of the cumulative toner consumption amount data Wint in the cumulative toner consumption amount storage portion 124, in response to a command from the controlling means 140.

(Fluidity Level Determining Means)

Next, a fluidity level determining means 130 for estimating the fluidity level of toner (level of recovery of toner in terms of fluidity) in the developing apparatus during the detection of the toner amount in the developing apparatus will be described.

As described above in the background technology section, as the toner D in the developer storage portion 70 is left unattended for a certain length of time, it agglomerates because of its own weight (which generally is referred to as "toner compaction"), changing in fluidity (ability to flow). If the amount of the toner D in the developer storage portion 70 is detected with the use of an optical means, such as the one in this embodiment, while the fluidity of the toner D is different from the normal fluidity of the toner D, the detected amount of the toner D in the developer storage portion 70 is different from the amount of the toner D in the developer storage portion 70, which will be detected when the toner D is normal in fluidity.

Thus, a means is necessary for determining whether or not the toner D in the developer storage portion 70 has recovered to the normal level in fluidity while the agglomerated toner D is loosened by the driving of the toner stirring member 74.

Figure 7:
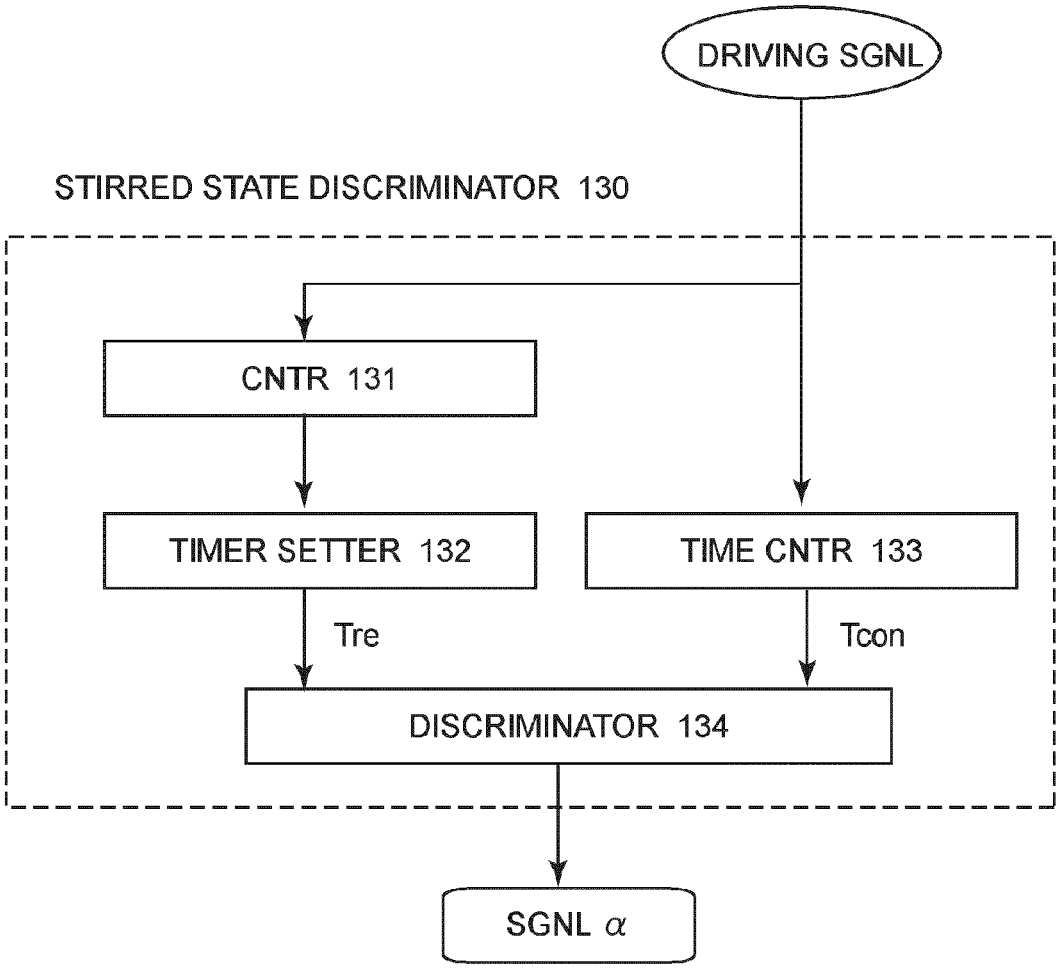
FIG. 7 is a block diagram of the circuit of the means for detecting the fluidity level of toner in the first embodiment of the present invention.

FIG. 7 is a block diagram of the circuit of the fluidity level determining means 130.

The fluidity level determining means 130 is provided with a stir-less length of time counter 131, a stir time length setting portion 132, a stir time length counter 133, and a fluidity level determining portion 134, as shown in FIG. 7.

The stir-less length of time counter 131 counts the length of time from the ending of the driving of the toner stirring member 74 which occurs at the end of an image forming operation, to the beginning of the next driving of the toner stirring member 74, and stores the counted length of time. That is, it counts the length of time the toner stirring member 74 is left stationary before the next image forming operation is started. As the restarting of the driving of the toner stirring member 74 is detected, the stirring time length setting portion 132 takes in from the stir-less length of time counter 131 the data regarding the length of time that the toner stirring member 74 has been left stationary. Then, it sets the length of time Tre (referential value to be referenced to determine whether or not the toner D has recovered in fluidity) the toner stirring member 74 will need to be rotated (driven) to restore the toner D in fluidity to the proper level for accurately detecting the amount of the toner D in the developer storage portion 70, based on the length of time the toner stirring member 74 has been kept stationary. The longer the stir-less length of time, the greater the length of time Tre the toner stirring member 74 needs to be rotated.

The stirring time length counter 133 counts the length of time Tcon (indexical value that indicates level of recovery of toner in fluidity) the toner stirring member 74 has been continuously driven since the driving of the stirring member 74 was restarted. The fluidity level determining portion 134 compares the length of time Tre set by the stirring time length setting portion 132 with the length of time Tcon counted by the stirring time length counter 133. If the length of time Tcon is greater than the length of time Tre (Tcon is greater than referential value, that is, indexical value for recovery), the fluidity level determining portion 134 outputs an "accurate measurement possible" signal a, which indicates that the toner D in the developer storage portion 70 has recovered in fluidity. Thus, when the length of time Tcon is less than the length of time Tre (Tcon is less than referential value, that is, indexical value, for toner recovery in fluidity), the stirring time length counter 133 does not output the "accurate measurement possible" signal α, which indicates that the toner D has been stirred enough for accurate measurement of amount of toner D remainder). Incidentally, the fluidity level determining means may be structured so that the "accurate measurement possible" signal α, which indicates the toner D has become satisfactory in fluidity, is outputted as the length of time Tcon exceeds the length time Tre.

(Control Sequence for Selecting More Reliable Data of Toner Remainder Amount)

Next, referring to FIGS. 8 and 9, the control of the selection of the toner amount detection data in this embodiment will be described.

Figure 8:
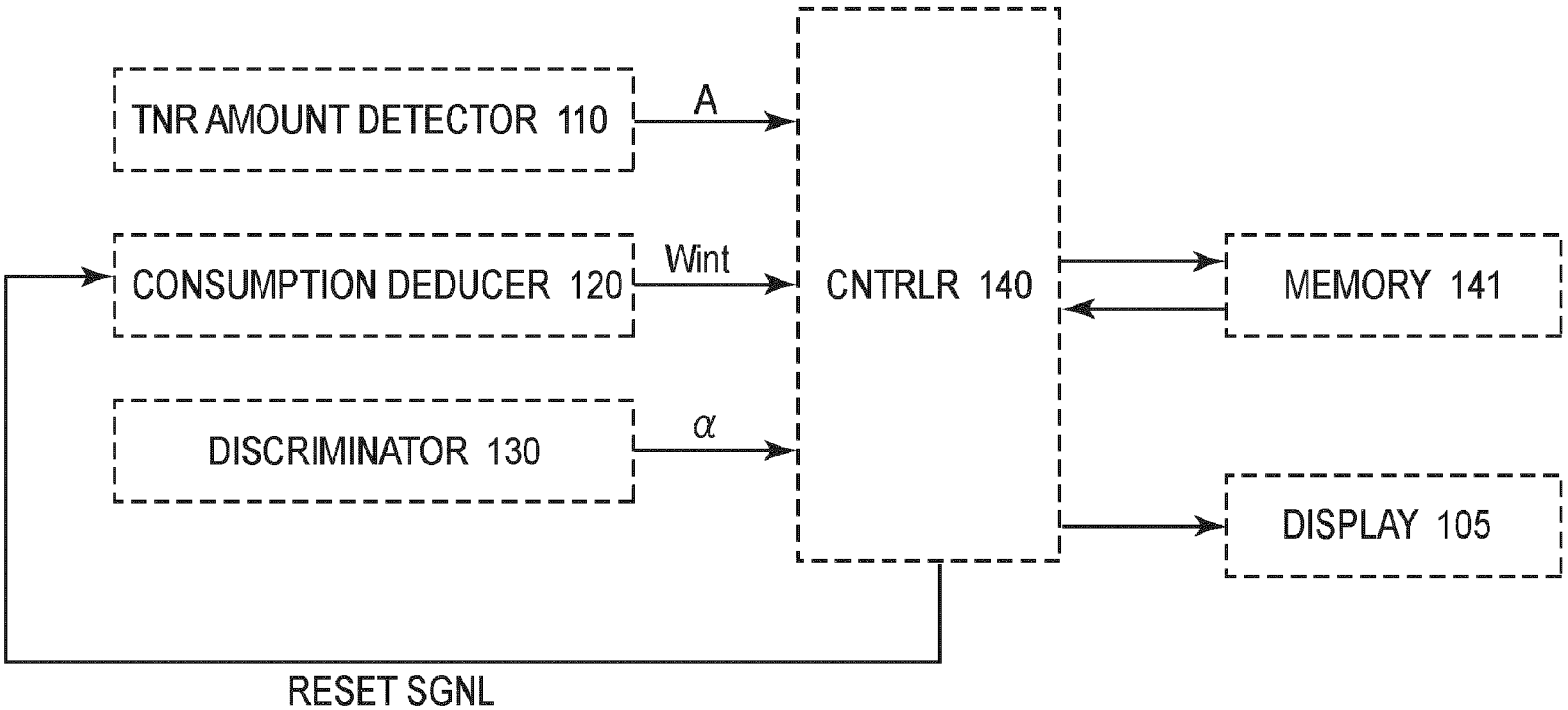
FIG. 8 is a block diagram of the control system in the first embodiment of the present invention.
Figure 9:
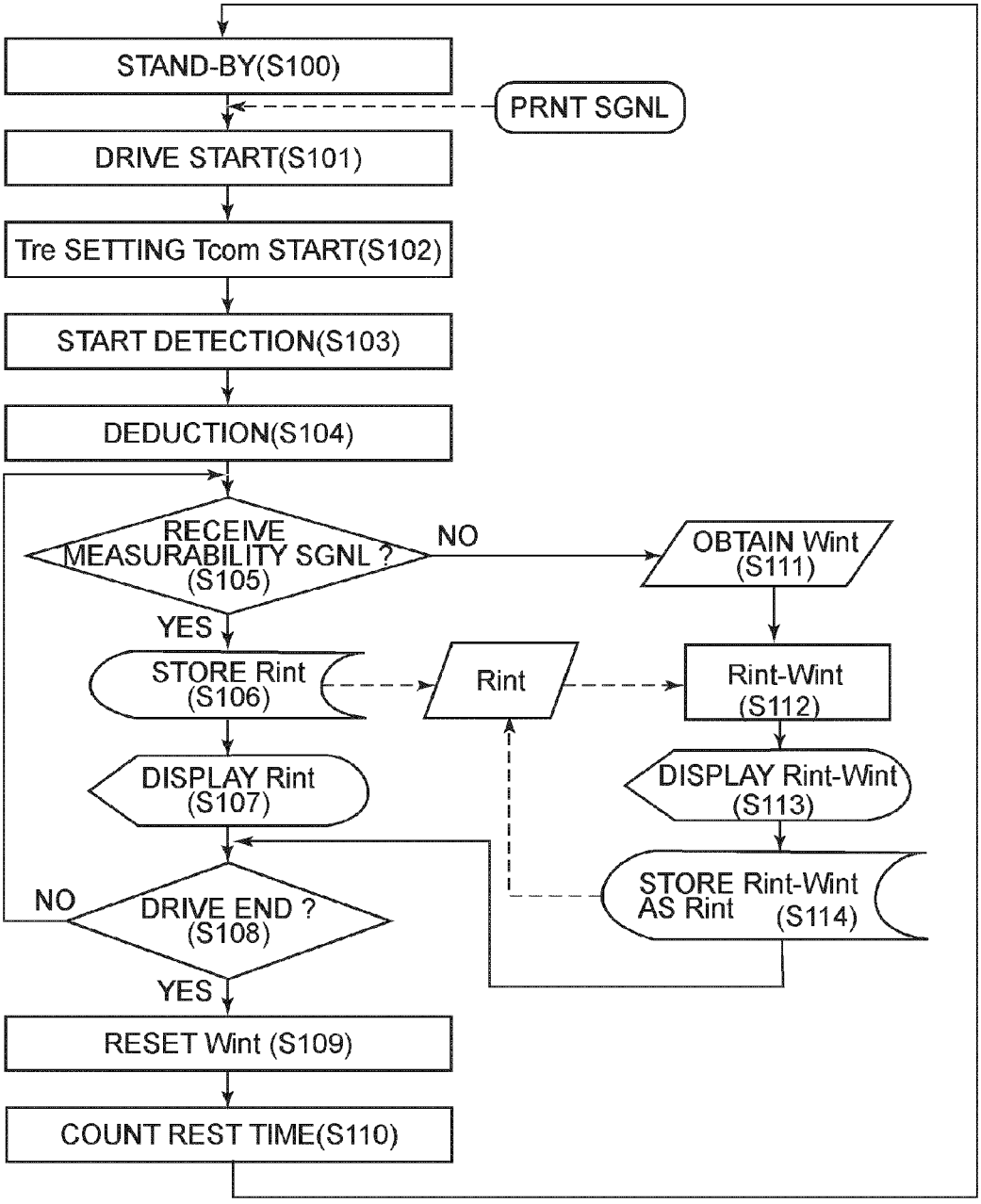
FIG. 9 is a block diagram of the control sequence for selecting more reliably a value for the toner remainder amount, in the first embodiment of the present invention.

FIG. 8 is a block diagram of the control system in this embodiment, and FIG. 9 is a flowchart of the control sequence for selecting more reliable data of the toner remainder amount.

Referring to FIG. 8, to the controlling means 140, the "accurate measurement possible" signal α from the fluidity level determining means 130, the detection data A from the toner amount detecting means 110, and the estimated cumulative amount Wint of toner consumption from the cumulative toner consumption estimating means 120, are inputted. The controlling means 140 is in connection with a data storage means 141 for storing the toner remainder amount Rint. Further, the controlling means 140 is in connection with the display portion 105 of the image forming apparatus, and outputs the toner remainder amount in the toner storage portion 70 to the display portion 105.

Next, referring to the flowchart in FIG. 9, the detail of the control executed by the controlling means 140 will be described.

The image forming apparatus is on standby (S100), so the fluidity level (state of toner) determining means 130 is continuing the counting of the length of stir-less time from the last interruption of the image forming operation. If it is immediately after the insertion of the process cartridge 2 into the image forming apparatus, the stir-less length of time is set to a preset default value.

As the image forming apparatus receives a print start signal, it starts driving itself, including its development unit 2*b* (S101). The fluidity level determining means 130 sets the value for the length of time Tre and begins to measure the length of time Tcon (S102). The toner amount detecting means 110 begins to detect the amount of the toner in the toner storage portion 70 (S103). Then, as the data regarding the image to be formed is developed by the formatter, and the exposing apparatus begins to operate, the consumption amount estimating means 120 also begins to calculate the amount of the toner D consumed for the image formation (S104). Next, it is checked with preset intervals whether or not the fluidity level determining means 130 outputted the "accurate measurement possible" signal α (S105).

As the fluidity level determining means 130 outputs the "accurate measurement possible" signal a (as indexical value exceeds referential value for toner fluidity recovery) to the controlling means 140 during an image forming operation, the value A outputted by the toner amount detecting means 110 is stored as the toner remainder amount data Rint, in the storage means 141 (S106). Then, the value is sent to the display portion 105 of the image forming apparatus, and is displayed (S107).

Thereafter, the controlling means 140 checks whether or not the image forming operation ended and the driving of the image forming apparatus ended (S108). If the controlling means 140 determines that the image forming operation has not ended, and the image forming apparatus is being driven, it takes the step S105 again.

If the controlling means 140 determines that the image forming operation has ended and the driving of the image forming apparatus has ended, it sends a reset command to the consumption amount estimating means 120 as soon as it confirms that the driving has ended. Then, it resets the value of the cumulative toner consumption amount data Wint to zero (S109). Then, the fluidity level determining means 130 begins to count the stir-less length of time (S110).

Thereafter, the image forming apparatus is put on standby (S100).

Until the fluidity level determining means 130 outputs the "accurate measurement possible" signal a to the controlling means 140 during the image forming operation (value of fluidity recovery index is no more than referential value), the controlling means 140 obtains the cumulative toner consumption amount data Wint from the consumption amount estimating means 120 (S111).

Then, the controlling means 140 subtracts the obtained cumulative toner consumption amount data Wint from the toner remainder amount data Rint stored in the storage means 141 (S112), and causes the display portion of the image forming apparatus to display the difference between Rint and Wint (S113), and stores the difference (Rint−Wint) in the storage means 141, as a new value for the Rint (S114).

Incidentally, when the process cartridge 2 is brand-new, the above-mentioned toner remainder amount data Rint is reset to the initial value.

Thereafter, the controlling means 140 advances to step S108, in which it checks whether or not the image forming operation has ended and the driving of the image forming apparatus has ended. As described above, if the apparatus is being driven, the step S105 is taken, whereas if the driving of the apparatus has ended, the steps S109 and S110 are sequentially taken. Thereafter, the image forming apparatus is put on standby (S100).

That is, the controlling means 140 switches the information (data) based on which it determines as the amount of the developer remaining in the developer storage portion, according to whether or not the fluidity level determining means 130 outputted the "accurate measurement possible" signal α. Incidentally, whether or not the fluidity level determining means 130 outputs the "accurate measurement possible" signal α is determined based on the information regarding the length of time the stirring member 74 continuously stirred the toner D from the time it started stirring the toner D during an image forming operation. In other words, the controlling means 140 switches the information (data) based on which it determines as the amount of the developer remaining in the developer storage portion, according to whether or not the fluidity level determining means 130 outputted the "accurate measurement possible" signal α.

If the fluidity level determining means 130 outputs the "accurate measurement possible" signal α, the controlling means 140 calculates the toner remainder amount, based on the detection result of the toner amount detecting means 110, and displays the calculated amount on the display portion. Then, it stores the calculated amount of toner remainder in the storage portion 141, as a new toner remainder amount (Rint).

Until the fluidity level determining means 130 outputs the "accurate measurement possible" signal α, the controlling means 140 calculates the toner remainder amount based on the amount (Wint) of toner consumption calculated by the toner consumption amount calculating portion, and displays the calculated toner remainder amount on the above-mentioned display. Then, it stores the calculated toner remainder amount in the storage means 141, as a new toner remainder amount (Rint). More concretely, the value obtained by subtracting the toner consumption amount (Wint) calculated by the toner consumption amount calculating portion, from the previous value of the developer remainder amount (Rint), is used as the current amount of the toner remainder.

In the case of the image forming apparatus in this embodiment, whether the date from the toner amount detecting means 110 is reliable or not is determined by the fluidity level determining means 130 by using the above-described controlling method, and the data from the toner amount detecting means 110 is used only when the data is determined to be reliable. When the data from the toner amount detecting means 110 is low in reliability, the data is compensated by the estimated amount of toner consumption calculated by the toner consumption amount estimating means 120, to ensure that the amount of the toner remaining in the toner storage portion 70 is detected at a preset level in accuracy of higher. Therefore, the image forming apparatus in this embodiment is capable of determining which of the toner remainder amount (value) detected by the toner remainder amount detecting system, and the toner remainder amount (value) estimated by the toner remainder amount estimating system, is higher in reliability, and selecting the amount (value) higher in reliability, as the amount of the toner remaining in the toner storage portion 70.

Incidentally, in this embodiment, the image forming apparatus is provided with the display portion for displaying the toner remainder amount so that the calculated (estimated) amount of toner remainder can be displayed on the display portion. However, this setup is not mandatory. For example, the toner remainder amount may be displayed on the monitor of the PC connected to the image forming apparatus. In such a case, the controlling means 140 transmits the information regarding the toner remainder amount to the PC.

Also in this embodiment, in order to prevent the data from the toner amount detecting means 110 from being unnecessary doubted in reliability, the image forming apparatus is controlled so that the method for determining the fluidity level of the toner in the toner storage portion 70 is adjusted according to the length of time the image forming apparatus has not been in use.

Embodiment 2

Next, the image forming apparatus in the second embodiment of the present invention will be described.

This embodiment is different from the first embodiment in the control system and toner amount detection control sequence. That is, this embodiment is characterized in that its toner remainder amount detection sequence is provided with additional steps, in which the toner stirring member is driven. In the following description of this embodiment, only the structural components of the image forming apparatus, which are different from the counterparts in the first embodiment, that is, only the portions of the control system and toner amount detection control sequence, which characterize this embodiment will be described; the structural components in this embodiment, which are the same as the counterpart in the first embodiment will not be described.

First, referring to FIGS. 10 and 11, the toner amount detection control in this embodiment will be described.

Figure 10:
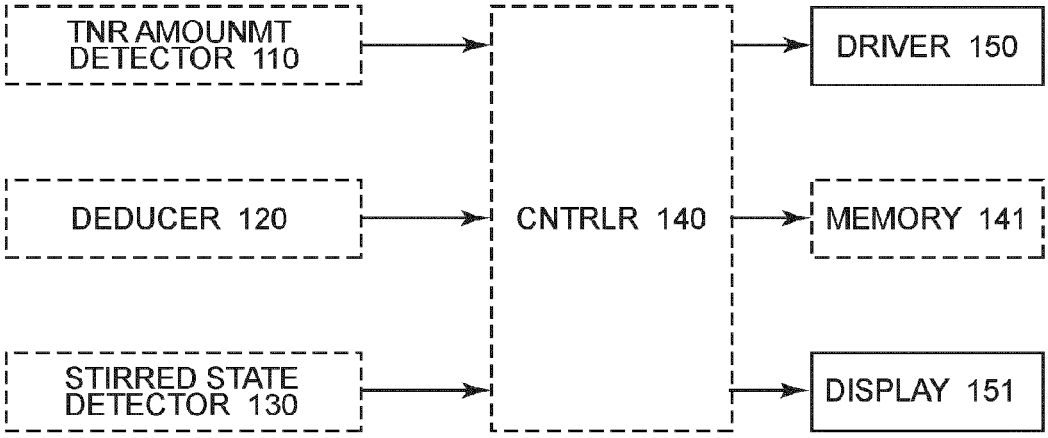
FIG. 10 is a block diagram of the control system in the second embodiment of the present invention.
Figure 11:
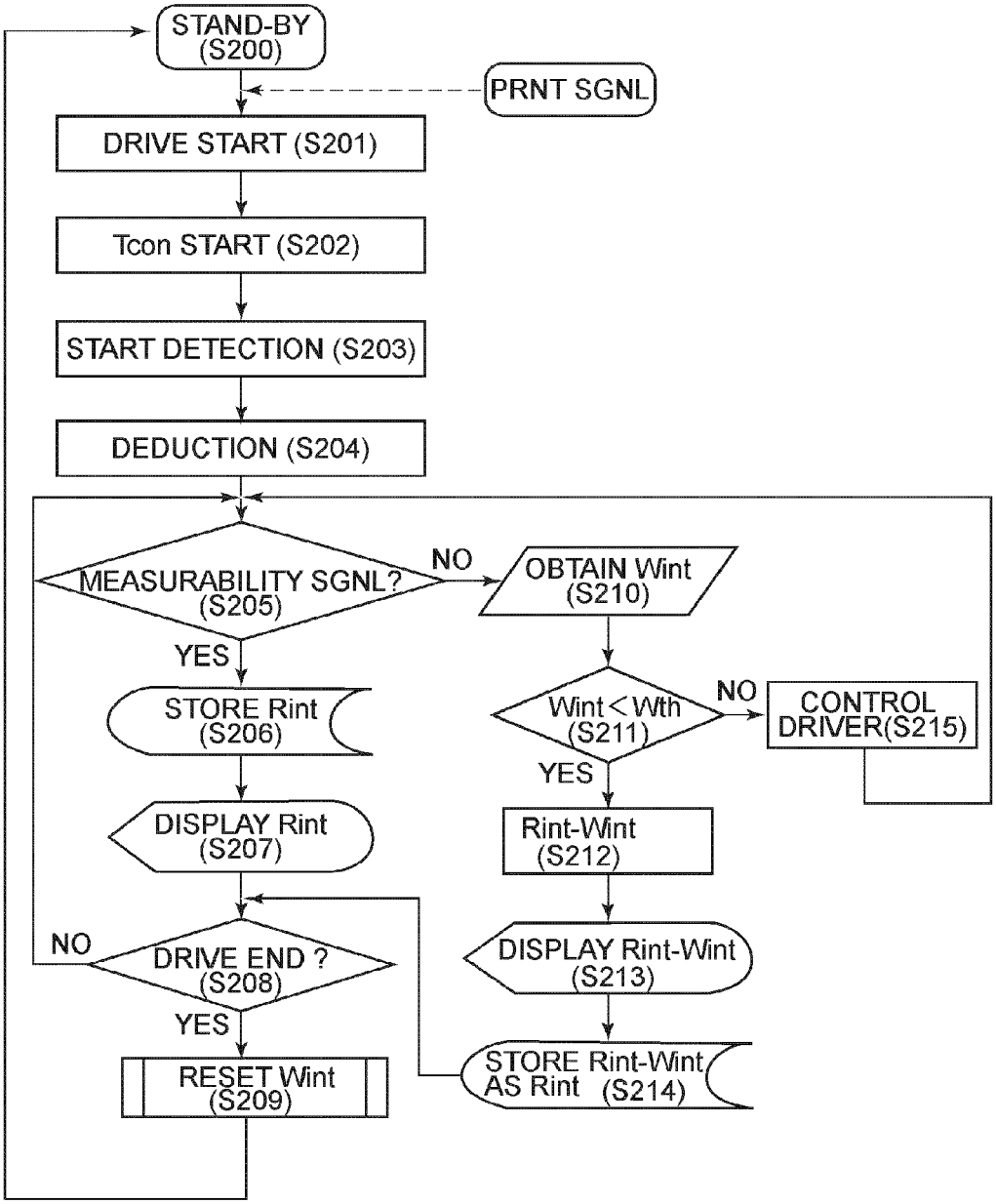
FIG. 11 is a block diagram of the control sequence for selecting more reliably a value for the toner remainder amount, in the second embodiment of the present invention.

FIG. 10 is a block diagram of the control system in this embodiment, and FIG. 11 is a flowchart of the toner amount detecting operation.

Referring to FIG. 10, this embodiment is different from the first one in that the image forming apparatus in this embodiment is provided with a driving means 150 for driving the developing apparatus, independently from the photosensitive drum 21 so that the length of time that the developing apparatus is driven can be varied as necessary by controlling the driving means 15 through the controlling means 140. Further, not only is the toner remainder amount data Rint stored in the storage means 141 connected to the controlling means 140, but also, the threshold value Wth (constant) for the toner consumption amount is set (stored) in advance in the storage means 141. The threshold value Wth for the toner consumption amount is provided as the threshold value for triggering the toner remainder amount detection sequence. The threshold value Wth for toner consumption amount is for regulating in length the toner consumption amount estimation period to prevent the estimated amount of toner consumption from becoming significantly different from the actual amount of toner consumption. In other words, it is the value for minimizing the requirement for starting the toner consumption amount detection sequence.

In the case of the fluidity level determining means 130 in this embodiment, the stir time Tre is set to a constant; it is not adjusted according to the length of stir-less period. More concretely, in this embodiment, the value of the stir time Tre is set to a constant which is equivalent to the continuous length of time necessary to continuously yield five copies of A4 size with some leeway. In other words, the image forming apparatus in this embodiment is structured so that unless a time Tcon, which is the length of time the toner stirring member 74 has been driven from the beginning of the driving of the stirring member 74, exceeds the above-mentioned constant to which the time Tre is set, that is, unless six or more copies of A4 size are continuously yielded, the "accurate measurement possible" signal a cannot be outputted.

Next, referring to the flowchart in FIG. 11, the control by the controlling means 140 in this embodiment will be described in detail.

The image forming apparatus is on standby (S202). As the image forming apparatus receives a print start signal, the controlling means 140 starts driving the image forming apparatus, including the development unit 2*b* (S201). The fluidity level determining means 130 begins to measure the length of the time Tcon (S202). The toner amount detecting means 110 begins to detect the amount of the toner in the toner storage portion 70 (S203). Then, as the data regarding the image to be formed is developed by the formatter, the exposing apparatus begins to operate, and the toner consumption amount estimating means 120 begins to calculate the estimated amount of the toner D consumed for the image formation (S204). Next, it is checked with preset intervals whether or not the fluidity level determining means 130 outputted the "accurate measurement possible" signal α (S205).

As the fluidity level determining means 130 outputs the "accurate measurement possible" signal α to the controlling means 140 during an image forming operation, a value A, which is the amount of the toner remainder detected by the toner amount detecting means 110, is stored as the toner remainder amount data Rint, in the storage means 141 (S206). Then, the control means 140 sends the value to the display portion of the image forming apparatus, and causes the display portion to display the value (S207). Thereafter, the controlling means 140 checks whether or not the image forming operation ended and the driving of the image forming apparatus ended (S208). If the controlling means 140 determines that the image forming operation has not ended, it takes the step S205 again.

If the controlling means 140 determines that the image forming operation has ended and the driving of the image forming apparatus has ended, it send a reset command to the toner consumption amount estimating means 120 to reset the value of the cumulative toner consumption amount data Wint to zero, as soon as it confirms that the driving has ended (S209).

Until the fluidity level determining means 130 outputs the "accurate measurement possible" signal a to the controlling means 140 during the image forming operation, the controlling means 140 obtains the data regarding the cumulative amount Wint of toner consumption from the toner consumption amount estimating means 120 (S210).

Then, the controlling means 140 compares the toner consumption amount threshold value Wth stored in the storage means 141, with the cumulative toner consumption amount data Wint (S211). When the cumulative toner consumption amount data Wint is less than the toner consumption amount threshold value Wth (no more than threshold value), the controlling means 140 subtracts the obtained cumulative amount of toner consumption data Wint, from the toner remainder amount data Rint stored in the storage means 141 (S212), and sends the difference between the Rint and Wint to the display portion of the image forming apparatus (S213), and displays the difference. Further, it stores the difference (Rint−Wint) in the storage means 141, as a new value for the Rint (S214).

Thereafter, the controlling means 140 advances to a step S208, in which it checks whether or not the image forming operation has ended and the driving of the image forming apparatus has ended. If the apparatus is being driven, the controlling means 140 takes the step S205 as described above, whereas if the driving of the apparatus had ended, the controlling means 140 takes the step S209, and the image forming apparatus is put on standby (S200).

If the cumulative toner consumption amount data Wint is no less than the threshold consumption amount value Wth, the controlling means 140 carries out the "toner remainder amount detection sequence", ended or not. In the "toner remainder amount detection sequence", the image forming operation is temporarily interrupted, and the driving means 150 is controlled so that the driving of the toner stirring member 74 is extended for a preset length of time (S215). Thereafter, the step S205 is taken again, in which it is checked whether or not the "accurate measurement possible" signal a has been outputted.

Once the image forming apparatus enters a loop of (S205)→(S210)→(S211)→(S215)→(S205), it cannot come out of this loop unless the fluidity level determining means 130 outputs the "accurate measurement possible" signal a. In other words, the toner stirring member driving time is extended until the length of the continuous driving time Tcon of the toner stirring member 74 exceeds the length of the time Tre. That is, until the value A of the toner remainder amount detected by the toner amount detecting means 110 becomes reliable, the image forming apparatus cannot come out of the above-mentioned loop, and therefore, the driving time is extended. This period in which the image forming apparatus enters this loop and the driving time is made longer than the length of time necessary for the image formation corresponds to the aforementioned additional steps in the "toner remainder amount detection sequence" in this embodiment. Incidentally, in this embodiment, it is checked whether or not the cumulative toner consumption amount data Wint is less than the threshold consumption amount value Wth. However, it may be set up so that it is checked whether or not the cumulative toner consumption amount data Wint is not-more than the threshold consumption amount value Wth.

The characteristic feature of the image forming apparatus in this embodiment is that the cumulative toner consumption amount data Wint is used to trigger the portion (steps) of the toner remainder amount detection sequence in this embodiment, in which the image forming apparatus is forced to extend the driving of the toner stirring means.

In, the past, there have been cases in which when the toner remainder amount detection system is insufficient in accuracy, the additional steps, such as those disclosed in Patent Document 3 is added to the "toner remainder amount detection sequence", in order to create a condition suitable for the detection of the developer remainder amount. The methods such as the above-mentioned one are effective to restore the toner remainder amount detection system in accuracy. However, there is a concern that frequent triggering of the additional steps in the "toner remainder amount detection sequence" reduces the image forming apparatus in performance (throughput, etc.). In particular, in the case of a development cartridge or a process cartridge, frequent triggering of the additional steps in the "toner remainder amount detection sequence" increases the amount of the load to which the cartridges are subjected when the stirring member is driven, and therefore, will possibly become one of the essential causes of the reduction in the durability of the cartridges (in particular, in a case where an image forming operation which is small in the amount of printing is frequently carried out).

In this embodiment, however, the threshold toner consumption amount value Wth is set as the trigger for the aforementioned additional steps in the "toner remainder amount detection sequence", limiting thereby the toner consumption amount estimating operation in length. Therefore, it is possible to prevent the problem that the estimated amount of toner consumption becomes significantly different from the actual amount of toner consumption. Further, it is possible to minimize the requirement for triggering the above-mentioned additional steps in the "toner remainder amount detection sequence".

More concretely, the frequency with which the additional steps of the toner remainder amount detection sequence are triggered is higher in the case of an image forming operation in which copies (images) are higher in print ratio, being therefore higher in toner consumption, whereas it is lower in the case of an image forming operation in which copies (images) are lower in print ratio, being therefore lower in toner consumption. That is, the image forming apparatus in this embodiment is controlled so that in a case where the amount by which the toner remainder amount changes is large, the toner remainder amount is frequently and actually measured, whereas in a case where the amount by which the toner remainder amount changes is small, the frequency with which the toner remainder amount is actually measured is reduced by determining the amount of toner remainder primarily by estimation.

As described above, in this embodiment, not only can the same effects as those obtained by the first embodiment, but also, the additional steps can be carried out in the "toner remainder amount detection sequence". Therefore, this embodiment can improve a toner remainder amount detecting means in accuracy, without reducing an image forming apparatus in performance (throughput, etc.), and without reducing a development cartridge or process cartridge in durability.

Incidentally, in this embodiment, if it is unnecessary to frequently and precisely display the toner remainder amount, the steps S212, S213, and S214 may be eliminated.

Embodiment 3

Next, the image forming apparatus in the third embodiment of the present invention will be described.

In this embodiment, instead of extending the length of time the toner stirring member 74 is driven as it is in the second embodiment, a "toner remainder amount detection subsequence" in which the stirring means is driven at a speed different from that at which the stirring means is driven during the image forming operation, after the completion of the image forming operation. The control system of the image forming apparatus in this embodiment is the same as that in the second embodiment. Therefore, only the portion of the toner remainder amount detection sequence, which makes this embodiment different from the second embodiment, will be described. The structural components of the image forming apparatus in this embodiment, which are the same as the counterparts in the second embodiment will not be described.

Figure 12:
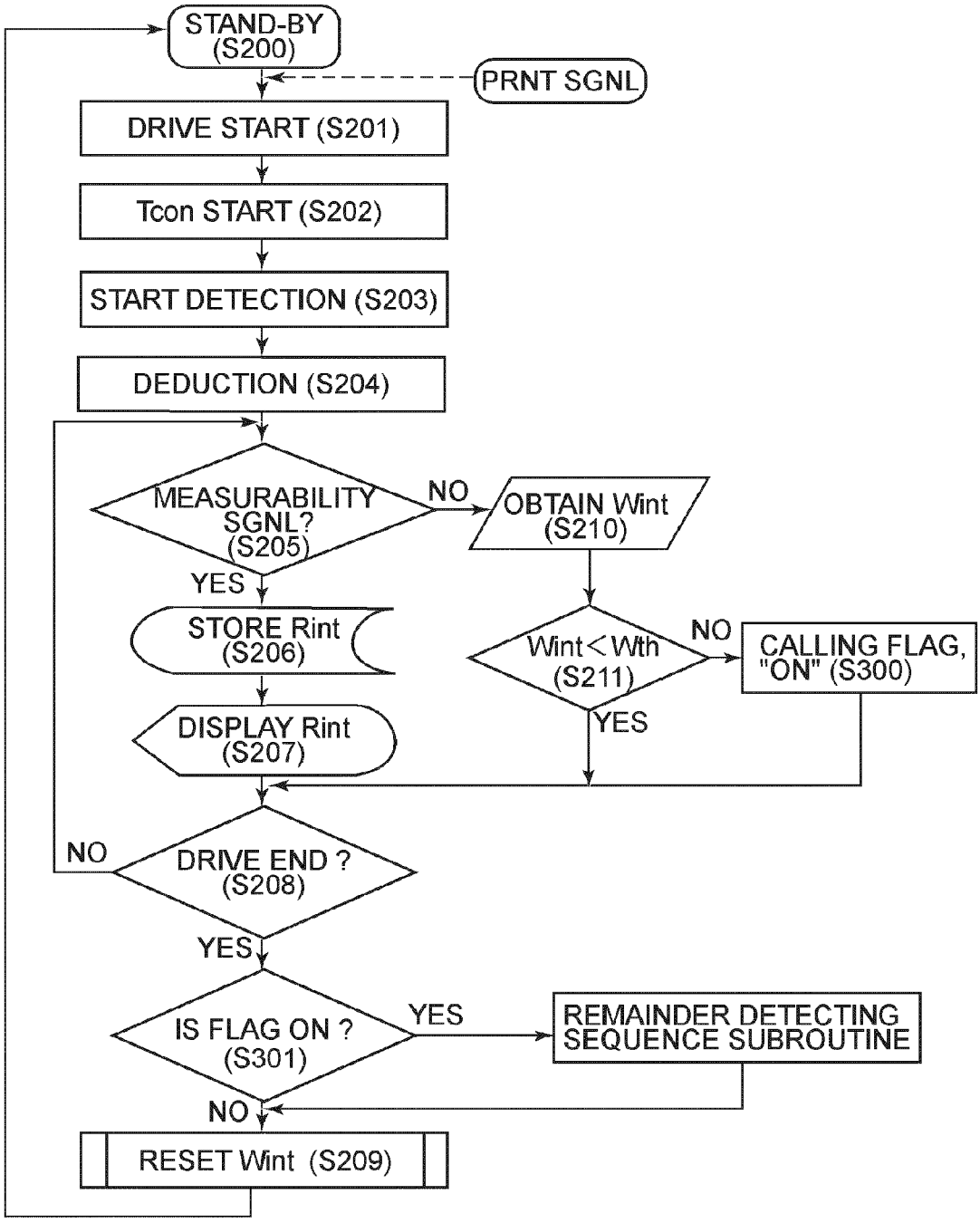
FIG. 12 is a block diagram of the control system in the third embodiment of the present invention.

FIG. 12 is a flowchart of the toner remainder amount detecting operation in this embodiment.

The steps in the toner remainder amount detecting operation in this embodiment, which are the same in function as the counterparts in the second embodiment are given the same referential symbols as those given to the counterparts, and will not be described. In this embodiment, the toner remainder amount detecting operation does not have steps which are equivalent to the steps S212, S213, and S214 in the second embodiment.

In the second embodiment, if the cumulative toner consumption amount data Wint is not less than the threshold consumption amount value Wth, the controlling means 140 makes the image forming apparatus enter the loop of (S205)→(S210)→(S211)→(S215)→(S205) to control the driving means 150 to extend the length of time the toner stirring member 74 is driven.

In this embodiment, instead, if the cumulative toner consumption data Wint is not less than the threshold consumption value Wth, a "toner remainder amount subsequence call flag" is turned on (S300). Then, after the image forming operation is ended and stopping of the driving of the toner stirring member 74 is confirmed (S208), it is checked whether or not the above-mentioned "call flag" is on (S301). If the call flag is not on, a step S209 is taken, and the image forming apparatus is put on standby (S200). If the call flag is on, the controlling means 140 makes the image forming apparatus enter the "subroutine of the toner remainder amount detection sequence".

Figure 13:
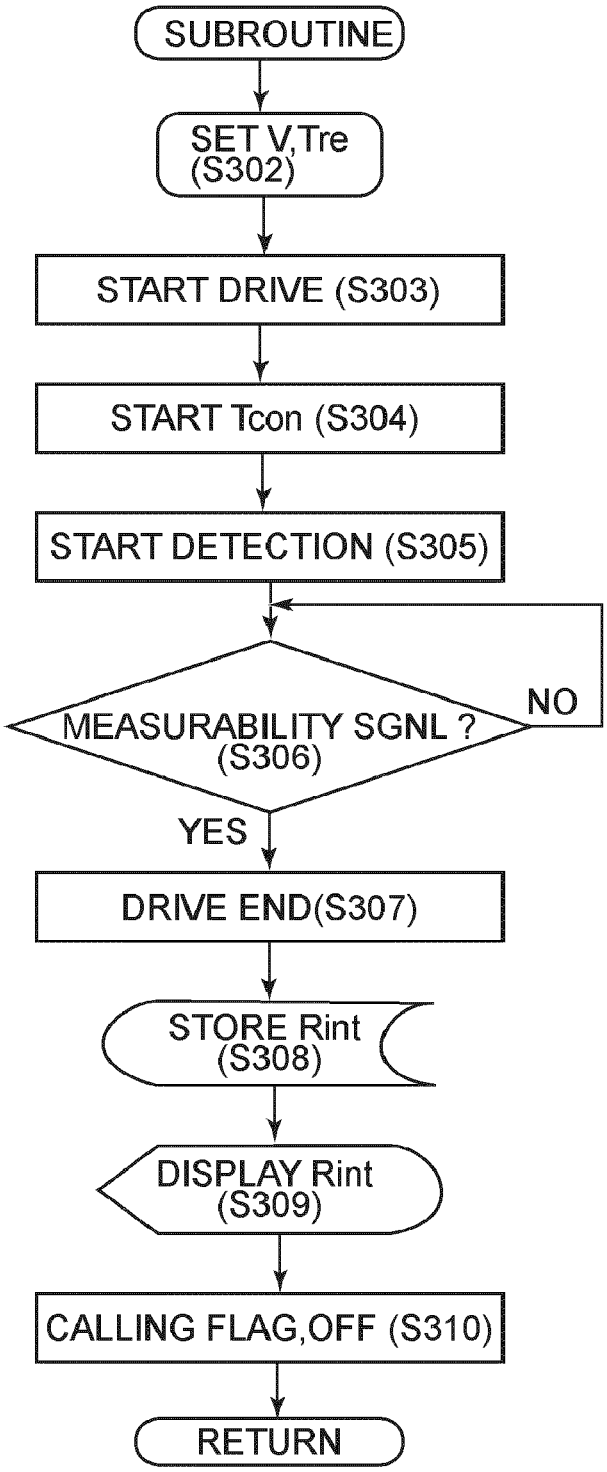
FIG. 13 is a flowchart of the subroutine of the developer remainder amount detecting sequence in the third embodiment of the present invention.

FIG. 13 is a flowchart of the subroutine of the toner remainder amount detecting operation in this embodiment.

As it is confirmed that a subroutine call flag is on, the controlling means 140 sets the toner stirring member driving speed V to an optimal value for the toner remainder amount detection, and the length of continuous stirring member rotation time Tre to a value which matches the value set for the toner stirring member driving speed V (S302). To describe in more detail, the controlling means 140 sends a dummy data from the stir-less time length counter 131 to the stirring time length setting portion 132 of the fluidity level determining means 130, so that the length of the continuous stirring member rotation time Tre matches the above-mentioned stirring member driving speed V (FIG. 7).

Then, the controlling means 140 starts driving the toner stirring member 74 at the above-mentioned driving speed V by controlling the driving means 150 of the image forming apparatus, inclusive of the development unit 2*b* (S303). The fluidity level determining means 130 begins to measure the length of the time Tcon (S302). The toner amount detecting means 110 begins to detect the amount of the toner in the toner storage portion 70 (S303). The controlling means 140 checks with preset intervals whether or not the fluidity level determining means 130 outputted the "accurate measurement possible" signal a (S306). In this embodiment, the "accurate measurement possible" signal α functions as a signal for ending the driving of the toner stirring member 74. Thus, as the fluidity level determining means 130 outputs the "accurate measurement possible" signal a to the controlling means 140, the controlling means 140 ends the driving of the toner stirring member 74 (S307). Immediately after ending the driving of the toner stirring member 74, the controlling means 140 makes the storage means 141 store the value A from the toner amount detecting means 110, as the toner remainder amount data Rint (S308). Then, it sends the value A to the display portion of the image forming apparatus to display the value (S309). Then, the controlling means 140 turns off the subroutine call flag (S310), ending the subroutine. Then, the controlling means 140 makes the image forming apparatus returns to the step S209.

In the step S209, the controlling means 140 resets the value of the cumulative toner consumption amount Wint to zero by sending a reset command to the toner consumption amount estimating means 120. Then, it puts the image forming apparatus on standby (S200).

Unlike in the first embodiment, in this embodiment, the amount of the toner remainder was detected while driving the toner stirring member 74 at a speed different from the speed at which the toner stirring member 74 is driven during an image forming apparatus. This is for dealing with cases, such as the following ones, by affording more latitude in the speed at which the toner stirring member 74 is driven during the toner remainder amount detecting operation.

(Case 1)

In the case of a toner amount detecting means, the accuracy of which is affected by the fluidity of toner, the toner stirring speed which makes the toner amount detecting means highest in accuracy is often different from the speed at which the toner stirring member must be driven during an image forming operation. Thus, in a case where the speed at which the toner stirring member is driven during a toner remainder amount detecting operation does not need to be the same as the speed at which the toner stirring member has to be driven during an image forming apparatus, the speed at which the toner stirring member is driven during the toner remainder amount detecting operation is desired to be the speed which makes the toner remainder amount detecting means highest in accuracy.

(Case 2)

In the case of an image forming apparatus, which can be changed in image formation speed to properly accommodate each of various recording media and/or to be changed in print property (for example, glossiness of print), the value of the toner remainder amount detected while driving the toner stirring member at the same speed as the speed at which the toner stirring member is driven in an image forming operation for yielding an image with specific properties, may be slightly different from the value of the toner remainder amount detected while driving the toner stirring member at the same speed as the speed at which the toner stirring member is driven in another image forming operation for yielding another image which is different in properties from the first image. Thus, in a case where the speed at which the toner stirring member is driven during a toner remainder amount detecting operation does not need to be the same as the speed at which the toner stirring member has to be driven during an image forming apparatus, the speed at which the toner stirring member is driven during the toner remainder amount detecting operation is desired to be a preset speed.

The characteristic of both cases is that the cumulative consumption amount data Wint obtained by the consumption amount estimating means 120 is used as the trigger for the subroutine of the toner remainder amount detection sequence, as in the second embodiment. Further, the requirement for triggering the subroutine of the toner remainder amount detection sequence is minimized by setting the threshold consumption amount value Wth as the trigger.

In this embodiment, the image forming operation is interrupted to start the toner remainder amount detection sequence. However, there is no specific reason for the interruption of the image forming operation. That is, the toner stirring member driving speed may be changed without interrupting the image forming operation. The gist of this embodiment is to afford more latitude in the toner stirring member driving speed. In other words, this embodiment encompasses the case in which the toner stirring member driving speed is not changed for the toner remainder amount detection sequence, unless it is required to change the speed.

Embodiment 4

Next, the image forming apparatus in the fourth embodiment of the present invention will be described.

This embodiment is different from the above-described third embodiment in the timing with which cumulative consumption amount data Wint is set to zero.

Figure 14:
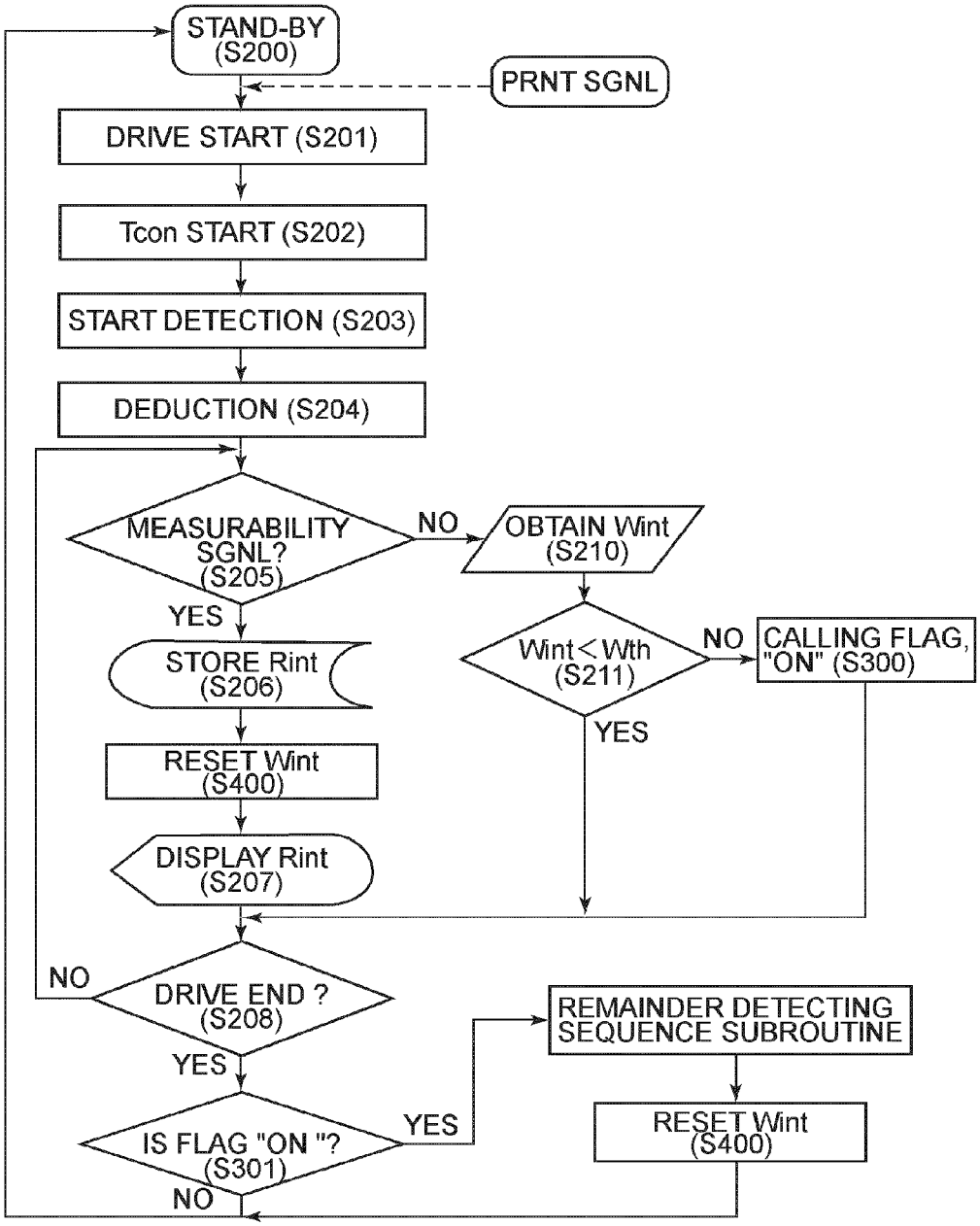
FIG. 14 is a block diagram of the control system in the fourth embodiment of the present invention.

FIG. 14 is a block diagram of the control system in this embodiment. The following description of this embodiment will be limited to the difference of this embodiment from the third embodiment. The structural components of the image forming apparatus in this embodiment, which are the same as the counterparts of the image forming apparatuses in the first to third embodiments, will be given the same referential symbols as those given to the counterparts, and will not be described.

In this embodiment, as the amount of the toner in the toner storage portion 70 is detected by the toner amount detecting means 110, the cumulative consumption amount data Wint is reset (S400). With the addition of this step S400, it is possible to deal with a case where a short image forming operation in which the amount of toner consumption is extremely small, is repeated, that is, a case where an image forming operation in which the "accurate measurement possible" signal (S205) is not received, and the cumulative toner consumption amount data Wint does not exceed the threshold consumption amount value Wth, is continuously repeated.

As described above, the gist of the present invention is to accurately determine the fluidity (looseness) level of the toner in the toner storage portion, with the use of a toner amount detecting means, the accuracy of which is affected by the fluidity of toner (looseness of toner), that is, the degree of recovery of toner in terms of fluidity (degree of recovery of toner in terms of looseness).

Therefore, not only is the present invention applicable to an optical toner amount detecting system, such as those in the preceding embodiments of the present invention, but also, any toner amount detecting means, the accuracy of which is affected by the fluidity (looseness) level toner. For example, the present invention is applicable to a toner amount detecting means which determines the amount of toner in a toner container by detecting the electrostatic capacity between a pair of electrodes positioned in the toner container, being therefore liable to be affected in accuracy by the fluidity level of the toner in the container.

Further, the structure of the fluidity level determining means does not need to be limited to those in the preceding embodiments. In the preceding embodiments, the length of time the toner stirring member 74 (power source for driving toner stirring member 74) is driven is used as the index of the recovery of toner in terms of fluidity. However, the index does not need to be limited to the length of time the toner stirring member 74 is driven. That is, instead of the length of time the toner stirring member 74 is driven, the cumulative number of the rotations of the stirring member may be used as the index. In particular, in a case where the effect of the inertia of a photosensitive member, a development roller, etc. which are expendable cannot be ignored, or in the like cases, controlling the toner remainder amount detecting operation based on the number of the rotations of the toner stirring member, with the provision of a means for directing detecting the number of the rotation of the stirring means, sometimes yields better results. The cumulative number of rotations of the stirring means (member) means the number of times the stirring means (member), which begins to be rotated as soon as an image forming operation is started, is continuously rotated from the time it begins to be rotated.

Further, instead of employing a mechanism for counting the length of time the stirring member is driven, or number of times the stirring member is rotated, a mechanism for detecting the amount of the torque necessary to drive the stirring means may be employed to numerate the change in the amount of torque necessary to drive the stirring member so that the amount of torque necessary to drive the stirring member can be used as the index for the recovery of toner in terms of fluidity. Immediately after the stirring means begins to be driven, the toner is low in fluidity, and therefore, the amount of torque necessary to drive the stirring means is high. Then, as the driving of the stirring member continues, not only does the amount of torque necessary to drive the stirring means gradually reduce, but also, the rate, with which the amount of torque necessary to drive the toner stirring means it reduces, also gradually reduces. It is when the rate, with which the amount of torque necessary to drive the stirring means reduces, becomes virtually zero that it is determined that the toner has been stirred for a sufficient length of time. As soon as it is determined that the toner has been stirred for a sufficient length of time, the toner remainder amount is calculated based on the detection result of the toner amount detecting means 110. When the length of time toner has been stirred is insufficient, the toner remainder amount is calculated based on the estimated amount of toner consumption, which is calculated by the consumption amount calculating portion. The index and structure of the fluidity level determining means does not need to be limited to those in the preceding embodiments, as long as it is possible to determine whether or not the length of time the toner stirring member has been continuously driven is sufficient, and therefore, the toner amount detecting means has been restored in reliability.

Needless to say, the threshold value set for the index for toner recovery in fluidity in order to determine whether or not the toner has recovered in fluidity has only to satisfy the gist of the present invention, that is, "to restore a toner amount detecting means in reliability". That is, it does not need to be limited to those in the preceding embodiments. For example, it may be a variable, such as the one in the first embodiment, which corresponds to the stir-less length of time, or a fixed value (constant), such as those in the second and third embodiments.

Further, the choices of the consumption amount estimating means do not need to be limited to those in the preceding embodiments. For example, although in the preceding embodiments, the amount of toner consumption is estimated with the use of the mathematical equation (1), an equation other than the mathematical equation (1) may be employed. Further, in the preceding embodiments, the picture element signals of an intended image developed by a formatter are counted. However, instead of counting the picture element signals, the cumulative amount of the electric current for driving the light emitting elements of a laser scanner, or an LED head of an exposing apparatus may be used. Obviously, the amount of toner consumption may be estimated based on an optimal combination among various indexes, such as the above-mentioned number of picture element signals, and cumulative amount of the light emitting element driving electric current. As long as the gist of the present invention, that is, "to restore the toner amount detecting means in reliability", is satisfied, the index and method for determining the fluidity level of toner does not need to be limited to those in the preceding embodiment.

Further, the electric circuit structures of the consumption amount estimating means, fluidity level determining means, and controlling means, do not need to be limited to those in the preceding embodiments. That is, one electric circuit may be independently provided for each function, or all the electric circuits for various functions may be integrated with the CPU. Further, one or more functions of each of the above-mentioned means may be separated from them. For example, a process cartridge, which is separable from the main assembly of an image forming apparatus, may be provided with a nonvolatile storage means capable of playing both the role of the cumulative toner consumption amount storage portion 124 of the toner consumption amount estimating means 120, and the role of the storage means 141 of the controlling means, which is for storing the toner remainder amount data Rint. With the employment of this structural arrangement, the index of the remaining length of the service life of a process cartridge can be stored in the process cartridge itself, yielding an additional effect that even if a process cartridge is mounted into the main assembly of an image forming apparatus different from the image forming apparatus from which the process cartridge was removed, the information regarding the remaining length of the service life of the process cartridge is not going to be lost.

Incidentally, it may be only when it is desired to more accurately detect the amount of developer remainder that the control in the preceding embodiments is carried out. For example, the toner amount detecting means may be designed so that when a development cartridge or process cartridge is brand-new, that is, when a sufficient amount of toner is in the toner storage portion, only the consumption amount estimating means is used to determine the amount of toner in the toner storage portion, whereas as the cumulative amount of toner consumption becomes substantial, one of the controls in the preceding embodiments begins to be carried to determine the toner remainder amount.

As described above, according to the embodiments described above, it is possible to provide an image forming apparatus capable of determining which of the toner remainder amount (value) detected by the toner remainder amount detecting system, and the toner remainder amount (value) estimated by the toner remainder amount estimating system, is higher in reliability, and selecting the amount (value) higher in reliability, as the amount of the toner remaining in the toner storage portion 70. Further, it is possible to provide an image forming apparatus capable of improving its toner remainder amount detecting means while minimizing the frequency with which the subroutine of the "toner remainder amount detection sequence" is triggered.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 178416/2007 and 167464/2008 filed Jul. 6, 2007 and Jun. 26, 2008 which are hereby incorporated by reference.

What is claimed is:

1. An image forming apparatus comprising:

a developing device for developing a latent image formed on an image bearing member on the basis of image information, into a developed image with a developer, said developing device including a developer accommodating portion for accommodating the developer and a stirring member for stirring the developer in said developer accommodating portion;

an optical remaining amount detecting device for detecting a remaining amount of the developer in said developer accommodating portion, by passing light through an inside of said developer accommodating portion;

a consumption amount calculation device for calculating a consumption amount of the developer on the basis of the image information; and an outputting device for outputting an information signal indicative of a developer remaining amount, wherein:

(1) when a drive time, which is an elapsed drive time of said stirring member since a start of continuously driving said stirring member during an image forming operation, is not shorter than a reference value, said outputting device outputs an information signal based on a detection result of said optical remaining amount detecting device, and (2) when the drive time is shorter than the reference value, a comparison is made between the consumption amount and a threshold, such that:

(2-1) when the consumption amount is not less than the threshold, the image forming operation is temporarily interrupted, said stirring member is rotated, and then said outputting device outputs the information signal based on the detection result, and (2-2) when the consumption amount is less than the threshold, said outputting device outputs an information signal based on the consumption amount.

2. An image forming apparatus comprising:

a developing device for developing a latent image formed on an image bearing member on the basis of image information, into a developed image with a developer, said developing device including a developer accommodating portion for accommodating the developer and a stirring member for stirring the developer in said developer accommodating portion;

an optical remaining amount detecting device for detecting a remaining amount of the developer in said developer accommodating portion, by passing light through an inside of said developer accommodating portion;

a consumption amount calculation device for calculating a consumption amount of the developer on the basis of the image information; and an outputting device for outputting an information signal indicative of a developer remaining amount, wherein:

(1) when a drive time, which is an elapsed drive time of said stirring member since a start of continuously driving said stirring member during an image forming operation, is not shorter than a reference value, said outputting device outputs an information signal based on a detection result of said optical remaining amount detecting device, and (2) when the drive time is shorter than the reference value, a comparison is made between the consumption amount and a threshold, such that:

(2-1) when the consumption amount is not less than the threshold, said stirring member is rotated after the image forming operation, and then said outputting device outputs the information signal based on the detection result, and (2-2) when the consumption amount is less than the threshold, said outputting device outputs an information signal based on the consumption amount.

3. An image forming apparatus according to claim 1, further comprising a storing device for storing the developer remaining amount, wherein:

when said outputting device outputs the information signal based on the detection result, the detection result rewrites the amount stored in said storing device, and when said outputting device outputs the information signal based on the consumption amount, a result of subtraction of the consumption amount from the developer remainder amount stored in said storing device rewrites the amount stored in said storing device.

4. An image forming apparatus according to claim 1, further comprising a display device for displaying the developer remaining amount, wherein:

when said outputting device outputs the information signal based on the detection result, the information in the information signal is displayed on said display device, and when said outputting device outputs the information signal based on the consumption amount, a result of subtraction of the consumption amount from a prior developer remainder amount is displayed on said display device.

5. An image forming apparatus according to claim 2, further comprising a storing device for storing the developer remaining amount, wherein:

when said outputting device outputs the information signal based on the detection result, the detection result rewrites the amount stored in said storing device, and when said outputting device outputs the information signal based on the consumption amount, a result of subtraction of the consumption amount from the developer remainder amount stored in said storing device rewrites the amount stored in said storing device.

6. An image forming apparatus according to claim 2, further comprising a display device for displaying the developer remaining amount, wherein:

when said outputting device outputs the information signal based on the detection result, the information in the information signal is displayed on said display device, and when said outputting device outputs the information signal based on the consumption amount, a result of subtraction of the consumption amount from a prior developer remainder amount is displayed on said display device.

* * * * *